United States Patent [19]

Moetteli

[11] Patent Number: 4,520,697

[45] Date of Patent: Jun. 4, 1985

[54] RATCHET WRENCH

[76] Inventor: John B. Moetteli, 11524 Royalshire Dr., Dallas, Tex. 75230

[21] Appl. No.: 427,449

[22] Filed: Sep. 29, 1982

[51] Int. Cl.[3] ..... B25B 13/46

[52] U.S. Cl. ..... 81/62; 81/63.2; 81/124.1; 81/124.3; 81/177.85; 192/43.1; 192/43.2

[58] Field of Search ..... 81/60–63.2, 81/124.1, 121 B, 121 A, 121 R, 177 G, 177 R; 192/43.2, 43, 43.1; 74/578; 403/329, 330; 145/72, 73

[56] References Cited

U.S. PATENT DOCUMENTS

| | | | |
|---|---|---|---|
| 125,695 | 4/1972 | Sanborn . | |
| 603,377 | 5/1898 | Fitch . | |
| 613,153 | 10/1898 | Kennelly . | |
| 897,584 | 9/1908 | Carlson | 81/63.1 |
| 1,165,995 | 12/1915 | Mossberg . | |
| 1,177,764 | 4/1916 | Dodge | 81/62 |
| 1,347,691 | 7/1920 | Forton . | |
| 1,995,009 | 3/1935 | Pfauser et al. | 192/43.2 |
| 2,300,479 | 11/1942 | Wilson . | |
| 2,317,461 | 4/1943 | Jackson . | |
| 2,518,139 | 8/1950 | Hallowell et al. | 81/177 G X |
| 2,549,515 | 4/1951 | Orey et al. . | |
| 2,651,230 | 9/1953 | Waterval . | |
| 2,688,268 | 9/1954 | Lear | 81/60 X |
| 2,715,955 | 8/1955 | Stone | 81/62 X |
| 3,078,973 | 2/1963 | Kilness | 192/43.2 |
| 3,096,659 | 7/1963 | Jenkins | 192/43.2 X |
| 3,208,318 | 9/1965 | Roberts . | |
| 3,253,626 | 5/1966 | Stillwagon, Jr. et al. . | |
| 3,299,750 | 1/1967 | Campanile et al. . | |
| 3,342,229 | 9/1967 | Janes | 81/62 X |
| 3,532,013 | 10/1970 | Haznar . | |
| 3,569,903 | 3/1971 | Brishka | 403/329 X |
| 3,677,102 | 7/1972 | Simonetta | 81/63 X |
| 3,732,756 | 5/1973 | Thomasian . | |
| 3,777,596 | 12/1973 | Smyers, Jr. et al. | 81/177 G |
| 3,881,376 | 5/1975 | Wright . | |
| 4,137,801 | 2/1979 | Imperio | 81/58.1 |
| 4,328,720 | 5/1982 | Shiel | 81/63 |
| 4,339,970 | 7/1982 | Enstrom | 81/60 |

FOREIGN PATENT DOCUMENTS 2138245 2/1972 Fed. Rep. of Germany .

OTHER PUBLICATIONS

P. 1417 of the Official Gazette of the Patent Office, vol. 883, No. 4.

*Primary Examiner*—Frederick R. Schmidt
*Assistant Examiner*—Debra S. Meislin
*Attorney, Agent, or Firm*—Richards, Harris, Medlock & Andrews

[57] ABSTRACT

An improved socket wrench (10) is provided which has an aperture (48) extending entirely through the drive portion of the wrench to permit the wrench to be used on spark plugs or deep set bolts or nuts without the need for an extension or long sockets. The socket wrench (10) includes a head (22) with an aperture (26) therethrough having ratchet teeth (30) thereon. A drive member (32) is mounted for rotation relative to the head and defines a slide surface (50) facing the ratchet teeth on the head. A pawl (54) is positioned between the slide surface and head with the pawl having two sets of ratchet teeth (58, 60). Each set of ratchet teeth on the pawl is engagable with the ratchet teeth on the head dependent upon the position of a resilient spring (85) moving in a curvilinear notch (67). A quick release mechanism is provided which includes a cylindrical portion (132) with depending resilient legs (134). Each leg includes a socket contacting surface for frictionally engaging a socket to retain the socket on the wrench. However, when the operator depresses the cylindrical portion, the legs deflect against a camming surface to release the sockets. A second embodiment provides a wrench (160) with pivotal ratcheting pawls (186). A third embodiment provides a breaker bar wrench (260) with a quick socket release feature.

35 Claims, 19 Drawing Figures

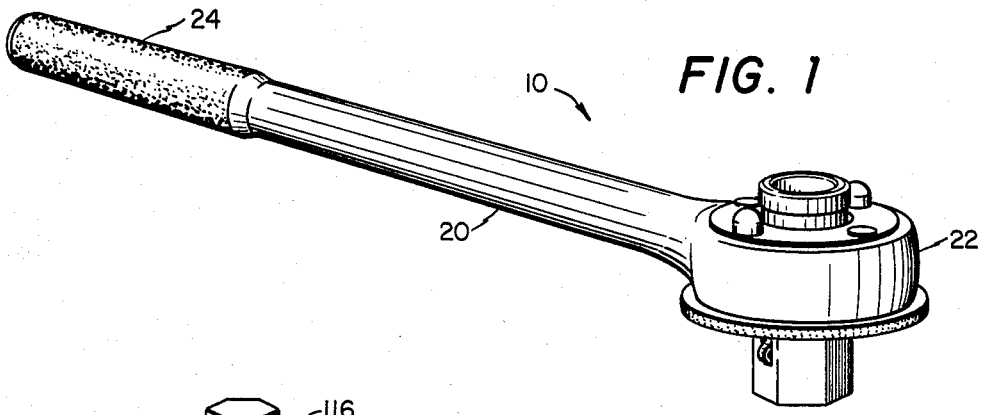
FIG. 1
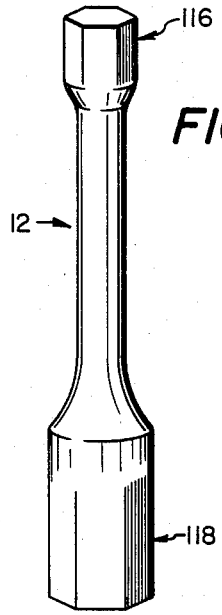
FIG. 2a
FIG. 2b
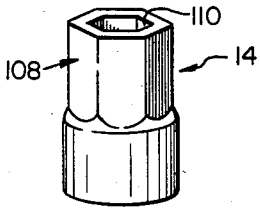
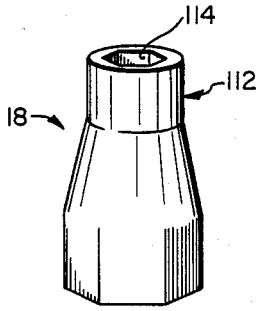
FIG. 2d
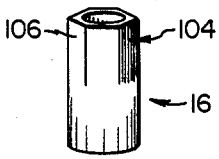
FIG. 2c

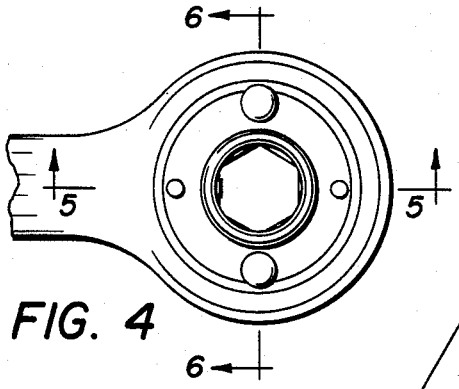
FIG. 4
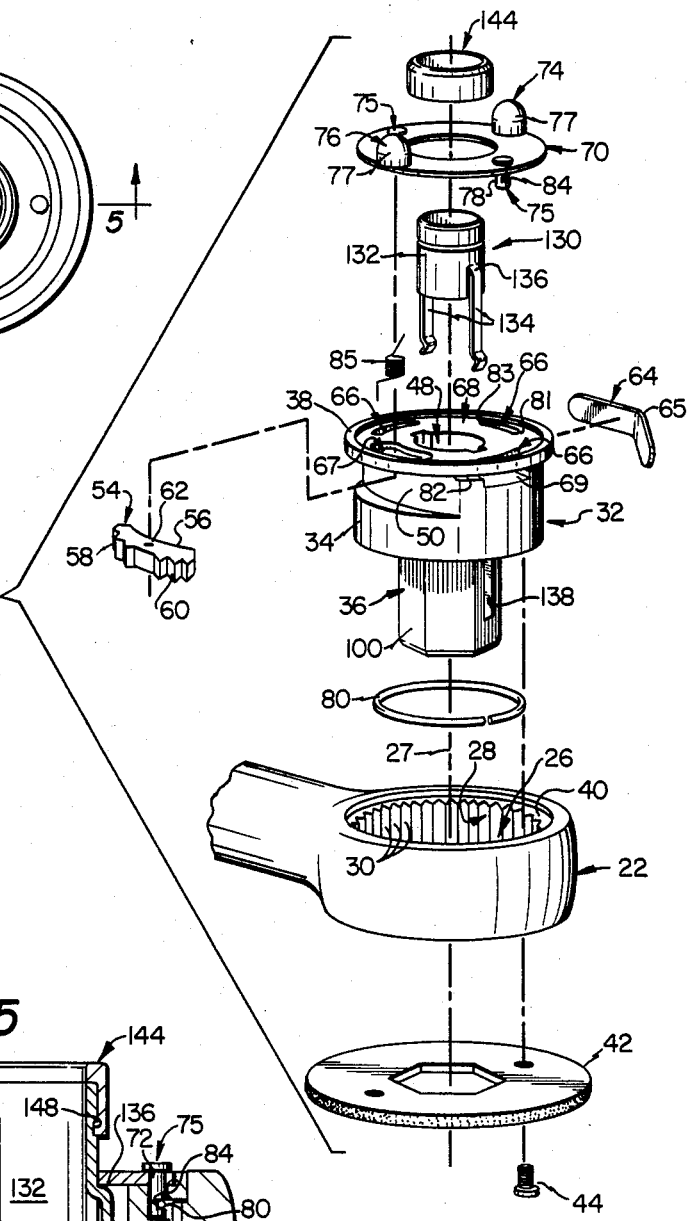
FIG. 3
FIG. 5
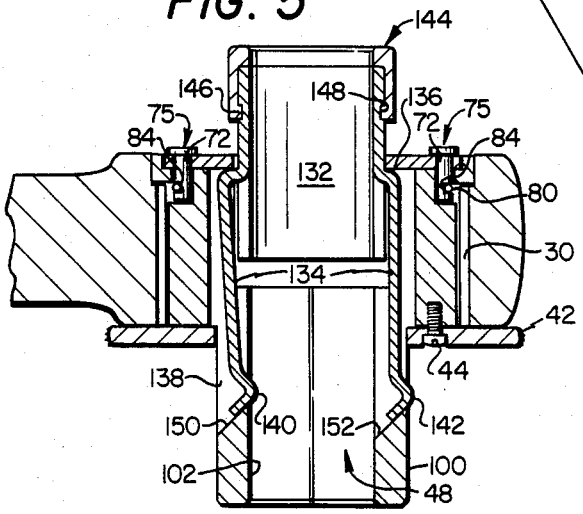

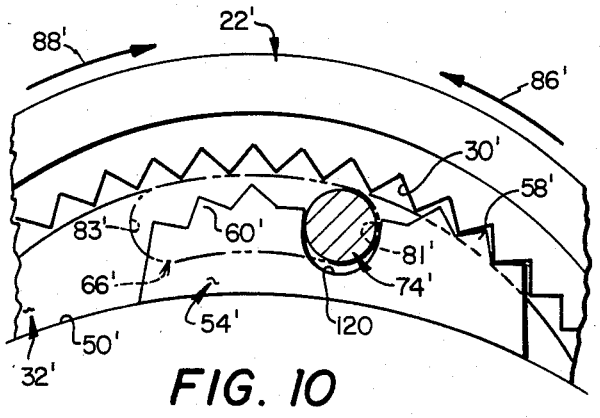
FIG. 10
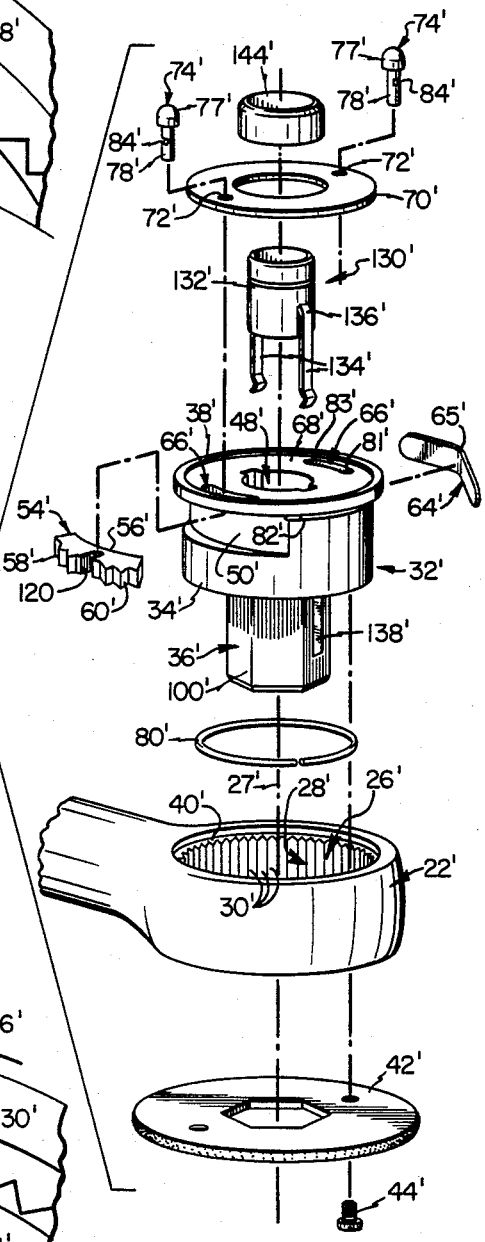
FIG. 9
FIG. 11
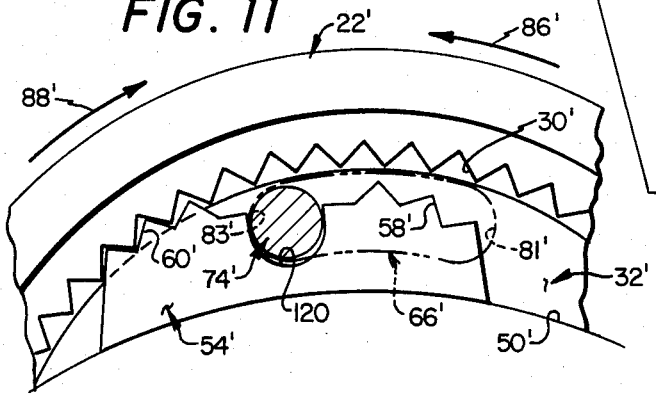

FIG. 12
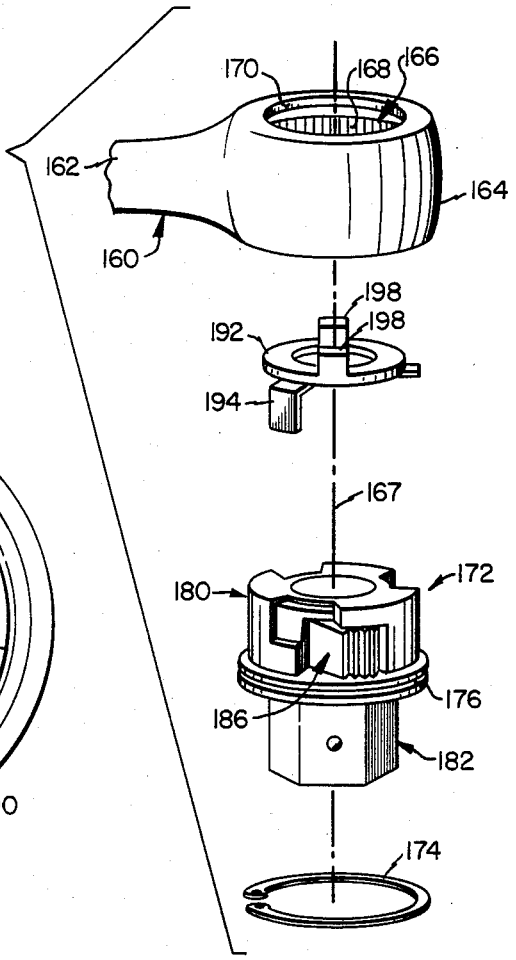
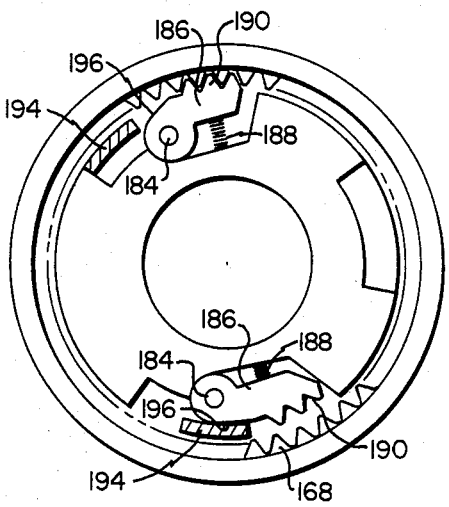
FIG. 13
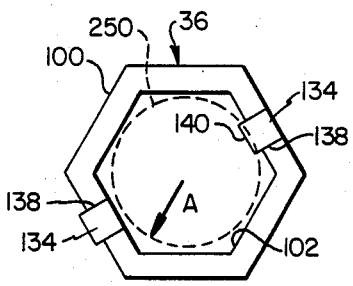
FIG. 14
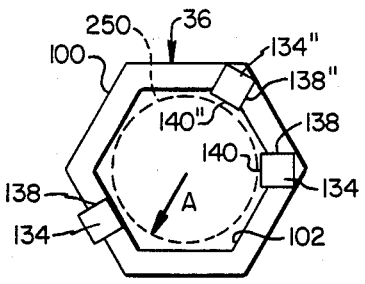
FIG. 15

RATCHET WRENCH

TECHNICAL FIELD

This invention relates to hand tools, and in particular to reversible ratchet wrenches for rotating fasteners.

BACKGROUND OF THE INVENTION

The ratchet wrench has several advantages over the conventional closed or open end wrench. The fastener to be tightened or loosened is commonly in a confined location where a wrench has only a limited arc of motion when placed on the fastener. With an open end or a closed end wrench, the wrench must be removed from the fastener each time the limit of the arc of motion is reached and then repositioned. The ratchet wrench can be retained on the fastener with the ratcheting mechanism permitting the wrench to be readily returned to the initial point of motion without the wrench being removed from the fastener. When a reversible ratchet is provided, the wrench can be rotated freely in either direction as needed.

The ratchet wrench has in the past had one significant shortcoming relative to the closed or opened ended wrench. The wrench engaging surfaces of the fastener can often be a considerable distance from the end of the fastener, such as where the fastener is the common automotive spark plug where the wrench engaging surfaces lie along the length of the spark plug, or when a member, such as a bolt on which the fastener is secured, extends through the fastener. The conventional closed or opened end wrench can be simply slid over the end of the spark plug or bolt onto the wrench engaging surfaces of the fastener. The common ratchet wrench is provided with a square drive to engage a square aperture in a socket. The ability of the socket to contact the wrench surfaces on the fastener is therefore determined solely by the length of the socket. Long experience has shown that two different length socket sets are required for the majority of applications, including a so-called "short" socket set for use in tight areas and a so-called "deep" socket set for use with spark plugs, fasteners with through bolts, etc. This leads to great expense in necessitating the purchase of two complete socket sets. In addition, as the wrench handle is moved away from the fastener to permit the longer "deep" socket to be positioned between the wrench and fastener, the user must be careful to avoid applying a moment perpendicular the desired rotational direction to avoid overstressing the fastener.

Attempts have been made to eliminate the need for multiple length socket sets in ratchet wrench design by providing a ratchet wrench having a hole through the wrench and centered on the axis of rotation of the drive portion of the ratchet wrench. U.S. Pat. No. 125,695 to Sanborn, U.S. Pat. No. 1,165,995 to Mossberg and U.S. Pat. No. 2,317,461 all disclose a ratchet wrench with a through hole. The wrench in each of these patents is adapted for only a single fastener size. U.S. Pat. Nos. 1,347,691 to Forton and 2,300,479 to Wilson each disclose a ratchet wrench with a through hole which is adapted for using interchangable sockets to use the wrench with a range of fastener sizes. However, none of the wrenches disclosed in these patents permit the ratcheting direction to be reversed without turning over the wrench.

In ratchet wrenches adapted for use with a socket set, it is common to provide a spring loaded detent to secure the socket on the drive member of the wrench during use. In recent years, mechanisms have been developed for quick release of the socket from the wrench by retraction of the detent. Such mechanisms are described in U.S. Pat. Nos. 3,208,318 to Roberts and 3,532,013 to Haznar. These mechanisms, however, require a number of parts, which increase costs, and cannot be readily disassembled for repairs.

At the present time, no single ratchet wrench has been developed which incorporates the desired advantages noted above, including the presence of a through hole to eliminate the need of multiple sets of sockets and incorporating a quick release mechanism for the sockets used. A need therefore exists for such a socket wrench which is relatively uncomplicated in design and adaptable for inexpensive quantity production.

SUMMARY OF THE INVENTION

In accordance with one aspect of the present invention, a ratchet wrench is provided for rotating a fastener. The ratchet wrench includes a handle having a head at one end thereof, the head having a cylindrical aperture formed therethrough centered on an axis. A drive member is mounted onto the handle and extends into the cylindrical aperture for rotation about the axis relative to the handle. The drive member is operably connected to the fastener so that rotation of the drive member rotates the fastener. The drive member further defines an aperture extending therethrough along the axis. Ratchet means are provided for selectively ratcheting the handle in either rotational direction about the axis relative to the drive member.

In accordance with another aspect of the present invention, a ratchet wrench for rotating a fastener is provided. The ratchet wrench includes a handle having a head at one end thereof. The head includes a cylindrical aperture formed therethrough and centered on a rotational axis. The wall of the head defining the cylindrical aperture has ratchet teeth thereon around the entire periphery of the wall. A drive member is mounted in the handle through the cylindrical aperture for rotation about the rotational axis relative to the handle. The drive member is operably connected to the fastener so that rotation of the drive member also rotates the fastener. The drive member defines a slide surface facing the ratchet teeth in the head and further defines an aperture therethrough extending along the rotational axis. A pawl is positioned between the slide surface on the drive member and the ratchet teeth of the head and defines first and second sets of ratchet teeth thereon in facing relation with the ratchet teeth on the head. Means are provided for moving the pawl between first and second positions relative to the slide surface so that in the first position, the pawl is jammed between the ratchet teeth of the head and the slide surface when the handle is rotated in a first direction relative to the drive member, the moving means permitting rotation of the handle in the opposite direction relative to the drive member. When the pawl is in the second position relative to the slide surface, rotation of the handle in the opposite direction relative to the drive member is prevented and the moving means permits rotation of the handle in the first direction relative to the drive member.

In accordance with another aspect of the present invention, means are provided for securing a socket onto the drive member. Means are also provided for deactivating the means for securing the socket to permit the socket to be removed from the drive member.

BRIEF DESCRIPTION OF THE DRAWINGS

A more complete understanding of the invention can be had by referring to the following Detailed Description together with the accompanying Drawings, wherein:

FIG. 1 is a perspective view of the first embodiment of an improved ratchet wrench constructed in accordance with the teachings of the present invention;

FIG. 2*a* is a perspective view of an extension for use with the ratchet wrench shown in FIG. 1;

FIG. 2*b* is a perspective view of a socket for use with the ratchet wrench shown in FIG. 1 with a female wrench engaging portion for rotating fasteners of relatively large size;

FIG. 2*c* is a perspective view of a socket for use with the ratchet wrench shown in FIG. 1 having a male wrench engaging portion for rotating fasteners of relatively small size;

FIG. 2*d* is a perspective view of a deep-dish socket for use with the ratchet wrench shown in FIG. 1 with a female wrench engaging portion;

FIG. 3 is an exploded view of one construction of the first embodiment of the ratchet wrench shown in FIG. 1;

FIG. 4 is a top view of a portion of the ratchet wrench shown in FIG. 3;

FIG. 5 is a partial cross-sectional view of the ratchet wrench shown in FIG. 3 taken along line 5—5 in FIG. 4 in the direction of the arrows;

FIG. 9 is an exploded view of a ratchet wrench forming another construction of the first embodiment designed in accordance with the teachings of the present invention;

FIG. 10 is a partial cut-away view of the ratchet wrench shown in FIG. 9 illustrating the ratcheting mechanism of the wrench positioned to prevent motion in a first direction;

FIG. 11 is a partial cut-away view of the ratchet wrench shown in FIG. 9 illustrating the ratcheting mechanism of the wrench in a position preventing motion in the opposite direction;

FIG. 12 is an exploded view of a ratchet wrench forming a second embodiment designed in accordance with the teachings of the present invention;

FIG. 13 is a cut-away view of the ratchet wrench forming the second embodiment illustrating the ratchet mechanism;

FIG. 14 is a cross-sectional view of the drive portion of the ratchet wrench forming the first embodiment;

FIG. 15 is a cross-sectional view of a modified drive portion; and

DETAILED DESCRIPTION

Figure 6:
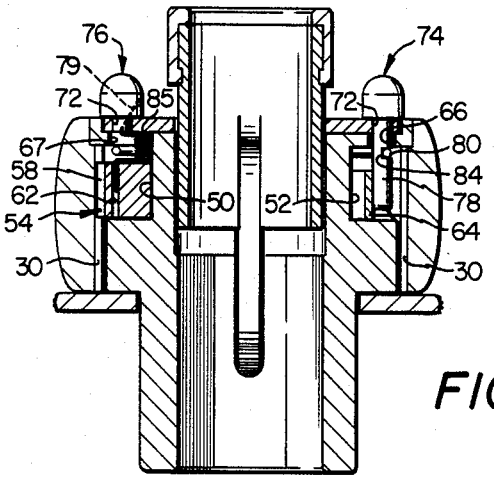
FIG. 6 is a partial cross-sectional view of the ratchet wrench of FIG. 3 taken along line 6—6 in FIG. 4 in the direction of the arrows.

Referring now to the drawings, wherein like reference numerals designate like or corresponding parts throughout several views, and in particular to FIGS. 1–8, there is illustrated a ratchet wrench 10 forming a first embodiment of the present invention which is adapted for use with an extension 12 and sockets 14–18, illustrated in FIGS. 2*a–d*, which also form a portion of the present invention, to rotate a fastener, such as a bolt, nut, or spark plug. It should also be understood that a fastener for purposes of this patent application will include any object or device which could be rotated or operated on by ratchet wrench 10.

As best shown in FIGS. 1 and 3–5, a first construction of the wrench 10 includes a handle 20 having an enlarged head 22 at one end and a knurled portion 24 at the opposite end for grasping by the user. As best seen in FIG. 3, the head 22 has a cylindrical aperture 26 formed therethrough centered on axis 27. The wall 28 of the head defining the cylindrical aperture is provided with ratchet teeth 30 parallel axis 27 and distributed along the entire periphery of the wall 28.

A drive member 32 is provided which generally includes a cylindrical portion 34 and a hexagonal drive portion 36. The upper edge of the cylindrical portion 34 has a flange 38 which rests on and rotates upon an annular inset 40 in the wall 28 of the head 22. The drive member 32 is secured to the handle 20 by a fastening plate 42 which is screwed into the underside of the cylindrical portion 34 by screws 44 as best seen in FIGS. 3 and 5. The fastening plate 42 has a sufficient diameter to contact the underside of the head 22 to prevent the drive member from separating from the handle 20. However, the drive member 32 is free to rotate within the head about axis 27. As can be seen in FIGS. 3 and 5, the drive member 32 has a large cylindrical aperture 48 which extends completely through the member and is centered on the axis 27. Aperture 48 permits the passage of a spark plug end, stud, rod, bolt or other elongate object so that the rachet wrench 10 can be used on a fastener without need of deep dish sockets. This feature also permits the wrench to lie closer to the fastener which allows the wrench to be used in confined spaces. It also reduces the components of force applied to a fastener by the wrench other than the rotational torque needed to rotate the fastener.

The drive member 32 is formed with a slide surface 50 and a spring receiving recess 52 which extend into opposite sides of the cylindrical portion 34 as best seen in FIGS. 3 and 6. The slide surface 50 is curved with a radius larger than the radius of the cylindrical portion 34 so that the edges of the slide surface merge with the outer surface of the cylindrical portion while the center of the slide surface is inset from the outer surface of the cylindrical portion. A pawl 54 is inserted between the drive member 32 and wall 28 to ride on the slide surface. The pawl 54 has a curved inner surface 56 for sliding on slide surface 50. The pawl 54 defines a first set of ratchet teeth 58 and a second set of ratchet teeth 60 on the side opposite surface 56. A vertical hole 62 is formed through pawl 54 between the teeth 58 and 60. The first and second set of ratchet teeth 58 and 60 face the ratchet teeth 30 on wall 28. A V-shaped spring 64 is inserted into recess 52 with its apex 65 facing the head 22 and centered within the recess 52.

Figure 7:
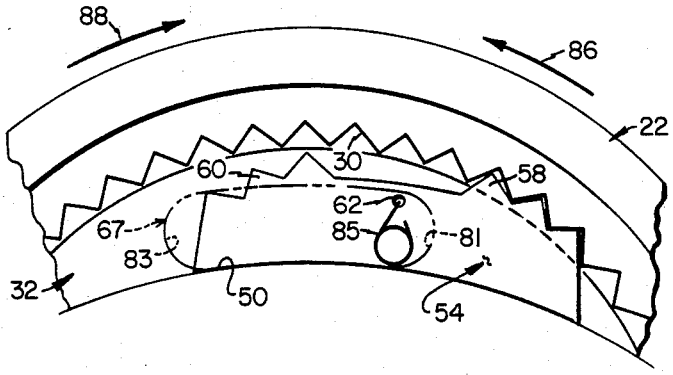
FIG. 7 is a partial cut-away view of the ratchet wrench shown in FIG. 3 illustrating the ratcheting mechanism of the wrench positioned to prevent motion in a first direction.
Figure 8:
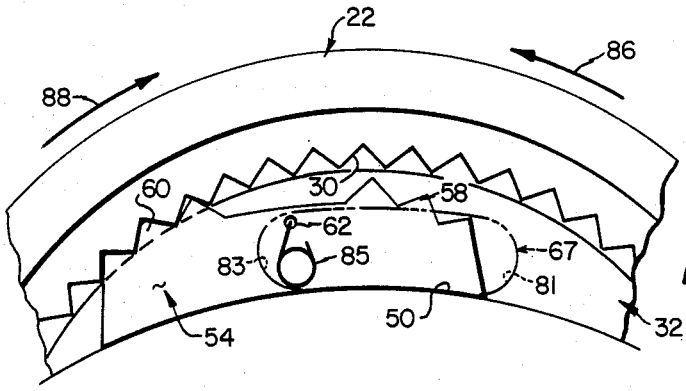
FIG. 8 is a partial cut-away view of the ratchet wrench shown in FIG. 3 illustrating the ratcheting mechanism in a position preventing motion in the opposite direction.

The drive member 32 is formed with three curvilinear notches 66 and one curvilinear notch 67 which extend from the upper surface 68 of the drive member into the member. The notches 66 and 67 are centered at a 90° angle apart from the adjacent notches about axis 27. Two notches 66 extend into cutouts 69 in cylindrical portion 34. Notch 67 and the other notch 66 extend into the insets defined by the slide surface 50 and recess 52, respectively. The hole 62 in the pawl 54 is continuously aligned with the curvilinear notch 67 when the pawl is positioned between the drive member 32 and wall 28 as seen in FIGS. 7 and 8.

An annular reverser plate 70 is positioned on the upper surface 68 and includes pin holes 72 to accept reverser pin 74, guide pins 75 and knob pin 76. The reverser pin 74 has a relatively large diameter knob portion 77 and a relatively reduced diameter portion 78. The holes 72 are sized to permit passage of portion 78 and block passage of portion 77. The portion 78 extends through the curvilinear notch 66 and into the spring recess 52 between spring 64 and wall 28. The knob pin 76 includes a knob portion 77 but does not extend below the bottom of reverser plate 70. A small hole 79 is formed in the knob pin 76 as best seen in FIG. 6 to receive one end of a rotary spring 85. The other end of spring 85 is received in hole 62 of pawl 54 while the main spiral body of spring 85 is contained within groove 67 of drive member 32.

A resilient ring 80 is provided which rests in a notch 82 formed in the drive member 32 and in notches 84 formed in the portion 78 of reverser pin 74 and guide pins 75 to retain the pins and reverser plate on the drive member 32 as best seen in FIGS. 5 and 6.

The ratcheting operation is explained as follows. The spring 64 urges the reverser pin 74 into one of two positions against the end walls 81 or 83 of the notch 66 as shown in FIG. 3. The pin 74 rotates the plate 70 as it moves between end walls 81 and 83. As plate 70 rotates relative to drive member 32, the spring 85 is extended and resiliently urges pawl 54 to move with the plate 70. When pin 74 abuts end 81, the spring 85 urges pawl 54 into a first position on slide surface 50 as seen in FIG. 7. When pin 74 abuts end 83, the spring 85 urges pawl 54 into a second position on slide surface 50 as seen in FIG. 8. In the first position illustrated in FIG. 7, the pawl is wedged between teeth 30 and one end of slide surface 50. In this position, if the head 22 is rotated in a direction indicated by arrow 86 in FIG. 7, the ratchet teeth 30 on the wall 28 will slide along the first set of ratchet teeth 58. The pawl 54 will move very slightly along the slide surface 50 to provide sufficient clearance for the ratchet teeth 30 to slide over the first set of ratchet teeth 58. The spring 85, constantly urges the pawl 54 into the first position between teeth 30 and the end of slide surface 50 to cause the pawl to spring back and create the ratcheting action. If, however, the handle 20 and head 22 are rotated in the opposite direction relative to drive portion 32, represented by arrow 88, the pawl is wedged between the slide surface 50 and the wall 28 with the first set of ratchet teeth 58 engaging the ratchet teeth 30 to lock the drive member 32 and head 22 together for joint rotation as when tightening or loosening a bolt or nut.

An operator can reverse the ratcheting operation of the socket wrench 10 by grasping the reverser pin 74 and knob pin 76 at knob portions 77 and moving the pin 74 to a second position at the opposite limit of travel permitted by the curvilinear notch 66 against end wall 83 as seen in FIG. 3. When the handle 20 and head 22 are rotated in the direction indicated by arrow 86, the pawl 54 is again wedged between the slide surface 50 and the wall 28 of head 22 as seen in FIG. 8. The second set of ratchet teeth 60 engage the ratchet teeth 30 on the head for joint rotation of the handle 20 and drive member 32. When the handle 20 and head 22 are rotated in the direction indicated by arrow 88, ratcheting action again occurs. The ratchet teeth 30 will slide along the second set of ratchet teeth 60 with the spring 85 urging the pawl 54 back into the second position to create the ratcheting action. The spring 64 constantly tends to urge the reverser pin 74 either to the first end wall 81 or to the second end wall 83 depending upon which side of the midpoint of apex 65 the pin is located. The reverser pin 74 flexes spring 64 to a maximum when the pin is in contact with apex 65 midway between the edges of the curvilinear notch 66. In this position, the spring 64 can drive the pin to either end wall of the curvilinear notch 66 depending upon which direction the pin is moved.

Another construction of the reverser mechanism of wrench 10 is illustrated in FIGS. 9, 10 and 11. Certain components of this construction are identical to the components described above and are identified by the same reference numeral with a superscript prime (′). In this construction, the drive member 32′ is formed with curvilinear notches 66′ which extend from the upper surface 68′ of the drive member and into the insets defined by the slide surface 50′ and spring recess 52′. The pawl 54′ includes a notch 120 which is continuously aligned with the notch 66′ opening adjacent slide surface 50′ when the pawl is positioned between the drive member 32′ and wall 28′ as seen in FIGS. 10 and 11. The annular reverser plate 70′ is positioned on upper surface 68′ and includes pin holes 72′ to accept reverser pins 74′. The reverser pins 74′ have a relatively large diameter knob portion 77′ and a relatively reduced diameter portion 78′. The holes 72′ are sized to permit passage of portion 78′ and block passage of knob portion 77′. The portions 78′ extend through the curvilinear notches 66′ adjacent the slide surface 50′ and into the spring recess 52′. A resilient ring 80′ is provided which rests in a notch 82′ formed in the drive member 32′ as best seen in FIG. 9 and in notches 84′ formed in the portion 78′ of each reverser pin 74′ to retain the reverser pins and reverser plate on the drive member 32′.

The ratcheting operation is substantially identical to that of the pawl 54 described hereinabove. However, the ratcheting function of the resilient spring 85 is performed by the spring 64′ which acts to urge pin 74′ extending into recess 52′ against either end wall 81′ or 83′ of notch 66. The force of spring 64′ acts through this pin 74′, plate 70′ and the second pin 74′ extending adjacent slide surface 50′ which bears against the walls of notch 120 in pawl 54′ as seen in FIGS. 10 and 11.

Referring again to ratchet wrench 10 shown in FIGS. 1–8, while the head 22 has been described as having an annular set of ratchet teeth 30, and drive member 32 a pawl 54, the present invention encompasses a design where a drive member has an annular set of ratchet teeth and the head supports the pawl.

The drive portion 36 of drive member 32 is adapted to secure any one of the sockets 14–18 thereon, as well as extension 12. The drive portion 36 defines an outer hexagonal surface 100 and an inner hexagonal surface 102. The socket 16 illustrated in FIG. **2*c* includes a male connector portion 104 which has a hexagonal outer surface 106 adapted for engagement with the inner hexagonal surface 102 of the drive portion 36. The socket 14 illustrated in FIG. 2*b* is provided with a female portion 108 which includes an inner hexagonal surface 110 for engagement with the outer hexagonal surface 100 of the drive portion 36. The design of socket 16 will be typically employed for small bolts, nuts, etc. Socket 14 can be employed with larger bolts or nuts. Sockets 14 and 16 each have a through center aligned with aperture 48 to permit use of wrench 10 on fasteners with bolts extending onto aperture 48, etc. The socket 18 includes a female connector portion 112 with an inner hexagonal surface 114 for engagement with the outer hexagonal surface 100 of the drive portion 36. The length of the socket 18 is considerably more than that of socket 14 to give the deep socket advantages to wrench 10 where the shank diameter of the bolt or rod to which the fastener is secured exceeds the diameter of aperture 48. The extension 12 includes a male connector portion 116 for engagement with the drive portion 36 and female connector portion 118 for use with either socket 14 or 16** if an extension is needed.

The hexagonal drive portion 36 is stronger and can withstand a higher rotational torque than a similarly sized square drive wrench. The length and weight of sockets 14–16 are also decreased over equivalent conventional sockets.

The socket wrench 10 is also provided with a socket locking and quick release feature. The member 130, best seen in FIGS. 3 and 5, has a cylindrical portion 132 and two resilient downwardly extending legs 134. The member 130 is placed in the aperture 48 in the drive member 32 prior to attachment of the reverser plate 70. Shoulders 136 defined between the cylindrical portion and legs contact the underside of the reverser plate 70 to keep the member 130 within the drive member 32. The drive portion 36 is provided with notches 138 on opposed hexagonal sides. The legs 134 extend into these notches as best seen in FIG. 5. The leg 134 seen on the left side in FIG. 5 has an inwardly bent shoulder 140 for bearing against the outer hexagonal surface of socket 16 and extension 12. This maintains the socket 16 or extension 12 on the socket wrench 10 with the frictional contact through the shoulder 140. The socket or extension can be provided with a notch about its outer hexagonal surface in which the shoulder 140 can enter. The leg 134 seen on the right in FIG. 5 has an outwardly directed shoulder 142 for frictional engagement with the inner hexagonal surface of the sockets 14 and 18. Again, the sockets 14 and 18 can have a groove on their inner hexagonal surface to accept the shoulder 142. A resilient button 144 is attached to the cylindrical portion 132 as seen in FIG. 5. The button can be provided with an annular edge 146 which enters a groove 148 on cylindrical portion 132. The button has a sufficiently larger surface area for contact with the operator to permit the operator to comfortably operate the socket locking and quick release feature. By pressing the button 144 downward toward the drive member 32, the member 130 is moved downward within the drive member and the shoulders 140 and 142 slide downward on camming edges 150 and 152 of the notches 138. The edges are angled so that the shoulders 140 and 142 retract into the notches 138 when the member 130 is depressed to release a socket or extension on the drive portion.

FIG. 14 illustrates the cross section of the drive portion 36 of drive member 32. The notches 138 are formed on opposite sides of the drive portion within the flat portions of the hexagonal sides. As is clear from FIG. 14, the inwardly bent shoulder 140 of the leg 134 employed to secure a socket 16 on the wrench can interfere with passage of an object 250 having a diameter A over which the wrench is placed to rotate the fastener. Object 250 could comprise, for example a rod, bolt or other structure.

An alternate design for the drive member 32 which prevents this interference is illustrated in FIG. 15. In this alternate design, the notch 138 which receives the leg 134 for holding a socket 16 is positioned at the corner between two flat surfaces of the hexagonal shape. In this design, the inwardly bent shoulder 140 extends from the inner section of the two adjacent hexagonal surfaces on inner hexagonal surface 102. This will permit free passage of an object 250 having a diameter A as shown in the FIG. 15 which could not pass through the drive portion as illustrated in FIG. 14. The alternate design also illustrates the use of a third leg 134'' lying within a third notch 138'' located between two flat surfaces of the drive portion 36. The leg 134'' also has a bent shoulder 140'' to hold a socket 16 to increase the force holding the socket.

It is readily apparent that socket wrench 10 incorporates the significant advantages desired in a socket wrench as noted previously. The ratcheting action is reversible without turning the wrench over by merely moving the reverser pins 74. In fact, to reverse the rachet operation, the knob portions 77 are always rotated in a direction to wedge pawl 54 between head 22 and drive member 32. Thus, drive member 32 need not be held against rotation relative to head 22 when reversing the wrench which permits reversal of the wrench with one hand. The aperture 48 within the drive member 32 permits a socket on the socket wrench 10 to be fit over a fastener to be rotated even though some portion of the fastener, or other part protrudes through the aperture 48. The socket wrench 10 also has the advantage of a socket locking and quick release feature which has only two pieces and which can be disassembled with the rest of wrench 10 for repair or maintenance.

A second embodiment of the present invention is formed by socket wrench 160, illustrated in FIGS. 12 and 13 and described hereinafter. The socket wrench 160 includes a handle 162 with head 164. The head is again provided with a cylindrical aperture 166 centered on an axis 167 having ratchet teeth 168 formed on the inner wall 170 of the aperture. A drive member 172 is secured within the aperture 166 by a snap ring retainer 174. The retainer 174 fits in a groove 176 formed about the drive member 172 and also into a groove in the wall 170 (not shown). The retainer 174 prevents movement of the drive member 172 along the axis 167 but permits the drive member 172 to rotate freely about the axis 167 relative to the handle 162.

The drive member 172 includes a cylindrical portion 180 and a drive portion 182 substantially identical to drive portion 36 in socket wrench 10.

The cylindrical portion 180 of the drive member 172 supports pawl pivot pins 184, pawls 186 and compression springs 188 as best seen in FIG. 13. The pawls 186 can pivot on the pins 184 about an axis generally parallel axis 167. Each pawl 186 is provided with a set of ratchet teeth 190. In the absence of an external force, the compression springs 188 urge the pawls about the pawl pins to engage the ratchet teeth 190 with the ratchet teeth 168 in head 164 as best seen with the upper pawl in FIG. 13. The ratchet teeth 190 are designed to engage and lock against ratchet teeth 168 in only one direction of relative motion while premitting the ratchet teeth to slide over one another during opposite rotation. A reverser plate 192 is confined between the edge on aperture 166 and the drive member 172. This reverser plate has two downwardly directed members 194 which are capable of contacting camming surfaces 196 on the pawls 186 to move the pawls out of engagement with the teeth 168. The members 194 are positioned on plate 192 so that each one of the pawls can be out of engagement with teeth 168 while the other pawl is engaged. The teeth 190 on pawls 186 are formed to prevent relative rotation between head 164 and drive member 172 in one direction, while permitting the teeth 168 to slide over teeth 190 in the opposite direction to provide a ratcheting action. The pawls 186 are mounted to prevent rotation in opposite directions so that ratcheting action can occur in either direction depending upon the position of the members 194. The reverser plate 192 can be moved relative to the drive member 172 through finger grips 198 to permit ratcheting of the socket wrench 160 in either direction.

Figure 16:
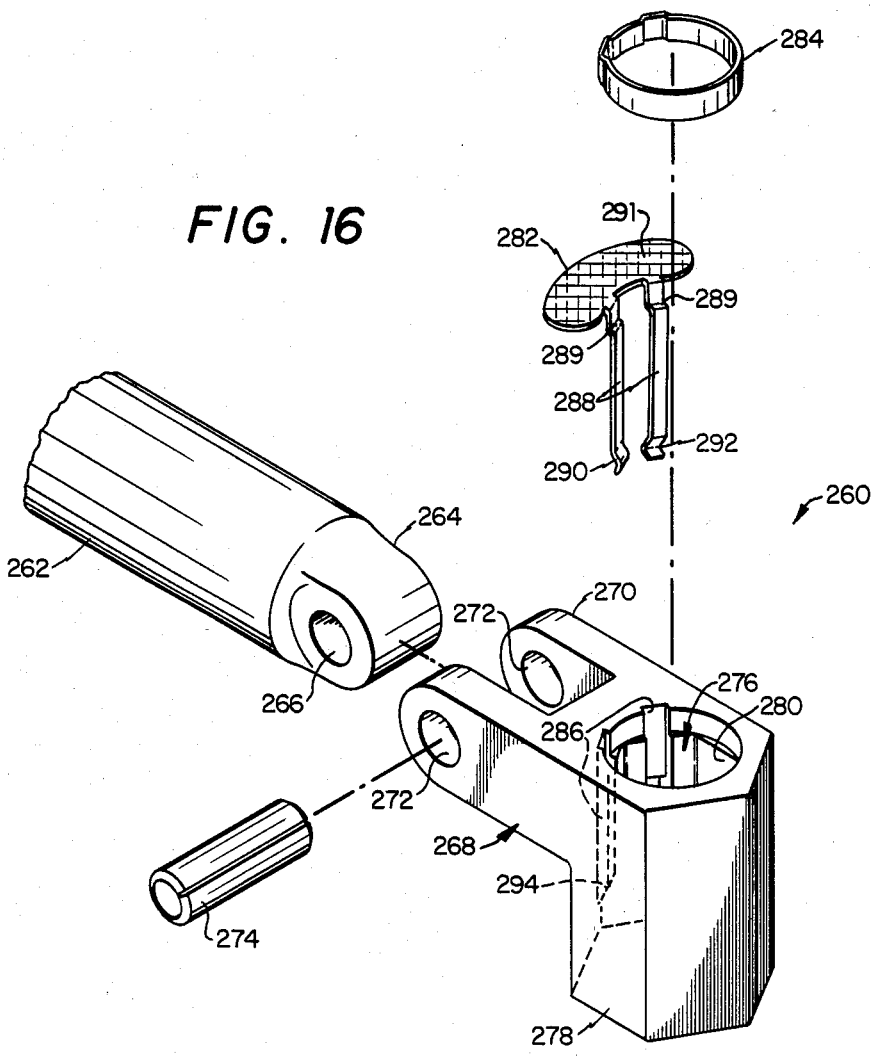
FIG. 16 is an exploded view of a breaker bar wrench forming a third embodiment of the present invention.

A third embodiment of the present invention is illustrated in FIG. 16 and comprises a breaker bar wrench 260. The breaker bar wrench 260 includes a long handle 262 with an end 264 having a reduced portion and an aperture 266. A head 268 also forms a portion of the breaker bar wrench 260 which includes a clevis 270 having an aperture 272 through the two arms of the clevis. The reduced end 264 of handle 262 can be received between the arms of the clevis 270 and a pin 274 can be inserted through the apertures 266 and 272 to secure the handle and head together. It will be clear that the pin 274 permits the head 268 to rotate about the axis of the pin relative to handle 262 but limits motion in any other direction.

The head 268 has a through aperture 276 which permits passage of a bolt, rod, spark plug or other object associated with the fastener to be rotated. The head defines an outer hexagonal surface 278 and an inner hexagonal surface 280 which can be used to secure sockets 14, 16 and 18 or extension 12 thereto in a manner substantially identical to the drive member 32 described in association with wrench 10.

The breaker bar wrench 260 has a socket locking and quick release feature which comprises the push button release 282 and a press fit retaining ring 284 which cooperate with notches 286 formed in the head 268. The push button release 282 includes two downwardly extending resilient legs 288 which are each received in one of the notches 286. The push button release 282 also defines a grooved surface 291 for contact with the finger of the operator. The press fit ring 284 is secured to head 268 by compression fit in aperture 276 and maintains the push button release 282 on the wrench 260 through contact with shoulders 289 on legs 288. The legs 288 operate in a manner substantially identical to the legs 134 within wrench 10 described hereinabove. One leg 288 has an inwardly bent shoulder 290 for bearing against the outer hexagonal surface of the socket 16 and extension 12 when they are in contact with the inner hexagonal surface 280 of the head 268. The other leg has an outwardly bent shoulder 292 which bears against sockets 14 and 18 when they are in contact with the outer hexagonal surface 278. The shoulders 290 and 292 secure the sockets or extension to the wrench 260. The bottom end of the notches 286 also include angled edges 294. When the push button release 282 is pushed downwardly toward the head 268 by the operator, the legs 288 are urged against the angled edges 294 to retract the shoulders 290 and 292 within the notches to release the sockets or extension. When released, the resiliency in the legs 288 returns the shoulders 290 and 292 to a position extending out of the notches for receiving a socket.

While several embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A ratchet wrench for rotating a fastener, comprising:

a handle having a head at one end thereof, the head having a cylindrical aperture formed therethrough centered on a rotational axis, a wall defining the cylindrical aperture defining ratchet teeth thereon surrounding its periphery;

a drive member for mounting onto the handle and extending into the cylindrical aperture for rotation about the rotational axis relative to the handle, said drive member having a drive portion, the drive portion having an outer surface having a noncircular cross section for operable connection to a fastener for rotating the fastener and an inner surface having a noncircular cross section for operative connection to a fastener for rotation of the fastener, said drive member further defining an aperture extending therethrough along the axis;

ratchet means mounted on said drive member to engage the ratchet teeth on the head for selectively ratcheting the handle in either rotational direction about the rotational axis relative to the drive member and for securing the handle and drive member for joint rotation about the rotational axis in the opposite rotational direction;

a release member mounted on the drive member for movement along the rotational axis with respect to the drive member; and at least one resilient means extending from an end of said release member and out of a notch in the drive portion for securing sockets to the drive portion, the notch having a camming surface thereon so that movement of the member in one direction along the axis with respect to the drive member cams said means out of engagement with the socket to permit removal of the socket.

2. A ratchet wrench for rotating a fastener, comprising:

a handle having a head at one end thereof, the head having a cylindrical aperture formed therethrough centered on a rotational axis, a wall defining the cylindrical aperture defining ratchet teeth thereon surrounding its periphery;

a drive member for mounting onto the handle and extending into the cylindrical aperture for rotation about the rotational axis relative to the handle, said drive member having a drive portion, the drive portion having an outer surface having a noncircular cross section for operable connection to a fastener for rotating the fastener and an inner surface having a noncircular cross section for operative connection to a fastener for rotation of the fastener, said drive member further defining an aperture extending therethrough along the axis; and ratchet means mounted on said drive member to engage the ratchet teeth on the head for selectively ratching the handle in either rotational direction about the rotational axis relative to the drive member and for securing the handle and drive member for joint rotation about the rotational axis in the opposite rotational direction said drive member defining a slide surface facing the ratchet teeth in the head, said ratchet means including:

a pawl positioned between the slide surface and the ratchet teeth of the head defining first and second sets of ratchet teeth in facing relation to the ratchet teeth on the head;

means including a first structure for contacting the pawl and a second structure to be contacted by the user of the wrench, said means for moving the pawl between a first and a second position relative to the slide surface through contact between said first structure and the pawl when the user contacts the second structure to reverse the ratcheting action of the ratchet wrench so that in the first position, the first set of ratchet teeth on the pawl and ratchet teeth on the head engage when the handle is rotated in a first direction about the rotational axis relative to the drive member for joint rotational of the handle and drive member, said means including a resilient third structure acting on the first structure to hold the pawl in a first position while permitting the first set of ratchet teeth on the drive member and ratchet teeth on the head to slip past each other when the handle is rotated in the opposite direction about the rotational axis relative to the drive member, said means for moving permitting the pawl to be moved to the second position through contact between said first structure and the pawl when the user contacts the second structure to reverse the ratcheting action of the ratchet wrench so that the pawl in the second position engages the second set of teeth on the pawl with the ratchet teeth on the head so that joint rotation of the handle and drive member occurs when the handle is rotated in the opposite direction about the rotational axis relative to the drive member, said resilient third structure acting on the first structure to hold the pawl in the second position while permitting the second set of ratchet teeth on the drive member and ratchet teeth on the head to move past each other when the handle is rotated in the first direction about the rotational axis relative to the drive member.

3. A ratchet wrench for rotating a fastener, comprising:

a handle having a head at one end thereof, the head having a cylindrical aperture formed therethrough centered on a rotational axis, a wall defining the cylindrical aperture defining a ratchet teeth thereon surrounding its periphery;

a drive member for mounting onto the handle and extending into the cylindrical aperture for rotation about the rotational axis relative to the handle, said drive member having a drive portion, the drive portion having an outer surface having a noncircular cross section for operable connection to a fastener for rotating the fastener and an inner surface having a noncircular cross section for operative connection to a fastener for rotation of the fastener, said drive member further defining an aperture extending therethrough along the axis;

ratchet means mounted on said drive member to engage the ratchet teeth on the head for selectively ratcheting the handle in either rotational direction about the rotational axis relative to the drive member and for securing the handle and drive member for joint rotation about the rotational axis in the opposite rotational direction said drive member has at least one inset in facing relation to the ratchet teeth on the handle, said ratchet means including:

first and second pawls having ratchet teeth formed thereon;

pins for pivotally mounting said first and second pawls in selected ones of the insets in the drive member for pivotal motion about a pivot axis parallel the rotational axis;

spring means acting between said first pawl and said drive member and acting between said second pawl and said drive member for urging the ratchet teeth on the first and second pawls into engagement with the ratchet teeth on the head, the ratchet teeth on the pawls and head being shaped so that engagement of the ratchet teeth on the first pawl and ratchet teeth on the head is maintained as the handle is rotated in a first direction about the rotational axis relative to the drive member to prevent rotation of the handle relative to the drive member in the first direction about the rotational axis while the teeth on the head and first pawl disengage as the handle is rotated in the opposite direction about the rotational axis relative to the drive member to permit independent rotation of the handle in the opposite direction about the rotational axis, the ratchet teeth on the pawls and head being shaped so that engagement of the ratchet teeth on the second pawl and ratchet teeth on the head is maintained as the handle is rotated in the opposite direction about the rotational axis relative to the drive member to prevent rotation of the handle relative to the drive member in the opposite direction about the rotational axis while the teeth on the head and second pawl disengage as the handle is rotated in the first direction about the rotational axis relative to the drive member to permit independent rotation of the handle in the first direction about the rotational axis; and an annular reverser plate mounted for pivotal motion on said drive member, a hole through the annular reverser plate coinciding with the aperture through the drive member, said annular reverser plate having a first member for contacting the first pawl to cam the first pawl out of engagement with the ratchet teeth on the head and a second member for contacting the second pawl to cam the second pawl out of engagement with the ratchet teeth on the head, pivotal motion of the annular reverser plate selectively camming one of said first and second pawls away from the head to disengage the ratchet teeth thereon and the ratchet teeth on the head to permit relative rotation between the handle and drive member in a selected direction.

4. A ratchet wrench for rotating a fastener, comprising:

a handle having a head at one end thereof, the head having a cylindrical aperture formed therethrough centered on a rotational axis, a wall defining the cylindrical aperture defining a ratchet teeth thereon surrounding its periphery;

a drive member for mounting onto the handle and extending into the cylindrical aperture for rotation about the rotational axis relative to the handle, said drive member having a drive portion, the drive portion having an outer surface having a noncircular cross section for operable connection to a fastener for rotating the fastener and an inner surface having a noncircular cross section for operative connection to a fastener for rotation of the fastener, said drive member further defining an aperture extending therethrough along the axis;

ratchet means mounted on said drive member to engage the ratchet teeth on the head for selectively ratcheting the handle in either rotational direction about the rotational axis relative to the drive member and for securing the handle and drive member for joint rotation about the rotational axis in the opposite rotational direction;

a quick release mechanism for releasing the socket from the drive portion, including:

a cylindrical member mounted on the drive member for limited movement along the rotational axis with respect to the drive member, an aperture through the cylindrical member being centered on the rotational axis, the cylindrical member having a finger engaging surface thereon; and at least one resilient spring member extending from said cylindrical member along the drive portion in a notch formed in the drive portion of the drive member, said resilient spring member having a socket engaging surface extending out of the notch for resiliently engaging the socket to secure the socket on the drive portion, the drive portion having a camming surface thereon so that movement of the cylindrical member in one direction along the rotational axis with respect to the drive member through contact by an operator pushing the finger engaging surface of the cylindrical member cams the resilient spring member out of engagement with the socket to permit removal of the socket.

5. A ratchet wrench for rotating a fastener, comprising:

a handle having a head at one end thereof, the head having a cylindrical aperture formed therethrough centered on a rotational axis, the wall defining the cylindrical aperture having ratchet teeth thereon around its periphery;

a drive member for mounting onto said handle and extending into the cylindrical aperture for rotation about the rotational axis relative to said handle, said drive member being operably connectable to the fastener so that rotation of the drive member rotates the fastener, said drive member defining a slide surface facing the ratchet teeth in the head, said drive member further defining an aperture extending therethrough along the rotational axis;

a pawl positioned between the slide surface and the ratchet teeth of the head and defining first and second sets of ratchet teeth in facing relation to the ratchet teeth on the head; and means including a first structure for contacting the pawl and a second structure to be contacted by the user of the wrench for reversing the ratcheting action of the ratchet wrench, said means for moving the pawl between first and second positions relative to the slide surface through contact between said first structure and the pawl when the user contacts the second structure to reverse the ratchet wrench so that in the first position, the first set of ratchet teeth on the pawl and ratchet teeth on the head engage with the pawl wedged between the slide surface and wall of the head when the handle is rotated in a first direction relative to the drive member about the rotational axis for joint rotation of the handle and drive member, said means further including a resilient third structure acting on the first structure to hold the pawl in the first position while permitting the first set of ratchet teeth on the pawl and ratchet teeth on the head to slip past each other when the handle is rotated in the opposite direction about the rotational axis relative to the drive member, said means for moving permitting movement of the pawl to a second position through contact between said first structure and the pawl when the user contacts the second structure to reverse the ratcheting action of the ratchet wrench so that the pawl in the second position engages the second set of teeth on the pawl and the ratchet teeth on the head with the pawl wedged between the slide surface and wall of the head so that joint rotation of the handle and drive member occurs when the handle is rotated in the opposite direction about the rotational axis relative to the drive member, said resilient third structure acting on the first structure to hold the pawl in the second position while permitting the second set of ratchet teeth on the pawl and ratchet teeth on the head to move past each other when the handle is rotated in the first direction about the rotational axis relative to the drive member.

6. The ratchet wrench of claim 5 further comprising means for securing a socket onto the drive member and means for deactivating said means for securing to permit the socket to be removed from the drive member.

7. The ratchet wrench of claim 5 wherein said drive member further includes a drive portion for connection to a socket to rotate the socket, the aperture being formed through the drive portion, said drive portion having an outer surface of noncircular cross section for connection to a socket and an inner surface of noncircular cross section for connection to a socket.

8. A quick release mechanism for releasing a socket from a wrench, the wrench having a handle and drive member mounted within the handle for rotation about an axis, the drive member having an aperture through its center and a drive portion having an outer surface and an inner surface, each surface for engagement with a socket, the aperture extending through the drive portion, the inner surface surrounding the aperture, comprising:

a cylindrical member mounted on the drive member for movement along the axis with respect to the drive member, an aperture through the cylindrical member in alignment with the aperture through the drive portion, the cylindrical member having a finger engaging surface; and at least one resilient spring member extending from an end of the cylindrical portion along the drive portion and a notch formed in the drive portion of the drive member, said spring member having a socket engaging surface extending out of the notch through one of said outer and inner surfaces for resiliently engaging a socket engaging said one of said outer and inner surfaces to secure the socket on the drive portion, the drive portion of the drive member having a camming surface thereon so that movement of the cylindrical member in one direction along the axis with respect to the drive member cams the resilient spring member out of engagement with the socket to permit removal of the socket.

9. The quick release mechanism of claim 8 wherein the quick release mechanism has at least two resilient spring members, each resilient spring member extending along the drive portion in a notch formed in the drive portion, one spring member having a socket engaging surface for engaging sockets contacting the outer surface of the drive portion and the outer spring member having a socket engaging surface for engaging sockets contacting the inner surface of the drive portion.

10. A ratchet wrench for rotating a fastener, comprising:

a handle having a head at one end thereof, the head having a cylindrical aperture formed therethrough centered on an axis, the wall of the head defining the cylindrical aperture having ratchet teeth thereon around its entire periphery;

a drive member for mounting onto said handle and extending into the cylindrical aperture for rotation about the axis relative to the handle, said drive member being operably connectable to the fastener so that rotation of the drive member rotates the fastener, said drive member having an inset in facing relation to the ratchet teeth of the handle;

at least one pawl having ratchet teeth formed thereon;

a pin for pivotally mounting said pawl in the inset of the drive member;

spring means acting between said drive member and said pawl for urging the ratchet teeth on the pawl into engagement with the ratchet teeth on the head, the ratchet teeth on the pawl and head being shaped so that engagement of the ratchet teeth prevents relative rotation between the drive member and the handle in a first direction about the axis;

an annular reverser plate mounted for pivotal motion on said drive member, said annular reverser plate having a first member thereon for camming the pawl to separate the ratchet teeth on the pawl and head to permit relative rotation between the handle and drive member in the first direction about the axis;

the drive member having a second inset in facing relation with the ratchet teeth on the head, a second pawl having ratchet teeth thereon, a second pin for pivotally mounting said second pawl in said second inset of the drive member and second spring means acting between said drive member and said second pawl for urging the rachet teeth of said second pawl into engagement with the ratchet teeth on the head, the ratchet teeth on the first and second pawls and head being shaped so that engagement of the ratchet teeth on the first pawl and ratchet teeth of the head prevent relative rotation between the head and drive member in a first direction about the axis and engagement of the ratchet teeth on the second pawl and ratchet teeth of the head prevent rotation in the opposite direction about the axis, said annular reverser plate having a second member for contacting the second pawl to cam the second pawl out of engagement with the ratchet teeth on the head, said annular reverser plate permitting selective disengagement of the ratchet teeth on the first and second pawls to permit rotation between the head and drive member in a desired direction about the axis.

11. A ratchet wrench for rotating a fastener, comprising:

a handle having a head at one end thereof, the head having a cylindrical aperture formed therethrough centered on an axis, the wall of the head defining the cylindrical aperture having ratchet teeth thereon around its entire periphery;

a drive member for mounting into said handle and extending into the cylindrical aperture for rotation about the axis relative to the handle, said drive member defining a slide surface facing the ratchet teeth on the head, said drive member further defining a curvilinear notch proximate the slide surface having first and second ends, said drive member having a drive portion operably connected with the fastener so that joint rotation of the drive member and fastener occurs, the drive member forming an aperture therethrough extending along the axis;

a pawl positioned between the slide surface on the drive member and the ratchet teeth of the head and defining first and second sets of ratchet teeth, the first and second sets of ratchet teeth being in facing relation to the ratchet teeth on the head;

a resilient member extending through the curvilinear notch and secured to the pawl;

means for moving the resilient member between the first and second ends of the curvilinear notch;

means for urging the resilient member against the first and second ends of the curvilinear notch when the resilient member is proximate the first and second ends, respectively; and movement of the resilient member sliding the pawl in the direction of movement of the resilient member so that when the resilient member is at the first end, the first set of ratchet teeth on the pawl engage the ratchet teeth on the head, the first set of ratchet teeth on the pawl engaging the ratchet teeth on the head and preventing motion of the handle relative to the drive member in a first direction about the axis while permitting the ratchet teeth to slide over each other when the handle is rotated in the opposite direction about the axis, and when the resilient member is adjacent the second end, the second set of ratchet teeth on the pawl are engaged with the ratchet teeth on the head, said second set of ratchet teeth engaging the ratchet teeth on the head to prevent the handle from rotating in the opposite direction about the axis relative to the drive member while permitting the teeth to slide over each other when the handle is rotated in the first direction relative to the drive member.

12. The ratchet wrench of claim 11 for use with a socket for rotating the fastener, the drive portion having inner and outer surfaces, the outer surface of the drive portion having a noncircular cross section adapted for receiving a socket and the inner surface of the drive portion having a noncircular cross section adapted for receiving a socket, the drive portion having two notches extending parallel to the axis, said ratchet wrench further comprising a quick release assembly including:

a cylindrical member mounted in the drive member for limited movement along the axis of rotation of the drive member with respect to the handle and having a finger contacting surface; and first and second resilient arms each extending from a first end of the cylindrical member and extending through one of the notches in the drive portion, the first resilient arm having a socket engaging surface thereon and being resiliently urged against a socket received on the outer surface of the drive portion, the second resilient arm having a socket engaging portion and being resiliently urged against a socket received on the inner surface of the drive portion, each resilient arm for securing a socket to the ratchet wrench, each of said notches having a camming surface contacted by the resilient arms when the cylindrical member is moved along the axis with respect to the drive portion by an operator pushing on the finger contacting surface to deflect the resilient arms to move a socket contacting surfaces out of engagement with the socket on the wrench to release the socket.

13. A wrench for use with sockets for rotating a fastener, each of the sockets having a portion for attachment to a wrench and a portion for engaging the fastener, the sockets each having an aperture therethrough for allowing the socket to engage the fastener when an object extends from the fastener by permitting the object to extend into the aperture, said wrench comprising:

a handle;

a drive member mounted on the handle and having a drive portion, the drive portion having inner and outer surfaces, the outer surface of the drive portion having a noncircular cross section adapted for receiving a socket and the inner surface of the drive portion having a noncircular cross section adapted for receiving a socket, said drive member and drive portion having a through aperture formed therein which forms a continuation of the aperture through a socket when the socket is received on the wrench permitting the object to extend through the drive member and drive portion;

a member mounted on the drive member for limited movement along the aperture and having a finger contacting surface; and at least one resilient arm extending from a first end of the member and extending through a notch in the drive portion, said resilient arm having a socket engaging surface thereon and being resiliently urged against a socket received on one of the surfaces of the drive portion, said resilient arm for securing a socket to the wrench, said notch having a camming surface contacted by said resilient arm when the member is moved along the aperture with respect to the drive portion in a first direction by an operator pushing on the finger contacting surface to deflect the resilient arm to move a socket contacting surface out of engagement with the socket of the wrench to release the socket.

14. The wrench of claim 13 wherein each of the inner and outer surface cross sections are hexagonal.

15. The wrench of claim 13 wherein the drive member is mounted on the handle for rotation about a rotational axis, said wrench further including ratchet means for selectively ratcheting the handle in either rotational direction about the rotational axis relative to the drive member.

16. A wrench for use with a socket for rotating a fastener, said wrench comprising:

a handle; and a drive member mounted on the handle and having a drive portion, the drive portion having inner and outer surfaces, the outer surface of the drive portion having a noncircular cross section adapted for receiving a socket and the inner surface of the drive portion having a noncircular cross section adapted for receiving a socket, each of said inner and outer surfaces extending along a first direction relative to said drive member;

a release member mounted on said wrench for limited movement along the first direction relative to the drive member and having a finger contacting surface thereon; and first and second resilient arms, each extending from a first end of the release member, said drive portion being formed with first and second notches extending along the first direction opening through the outer and inner surfaces, respectively, said first and second resilient arms extending into the first and second notches, respectively, the first resilient arm having a socket engaging surface thereon and being resiliently urged against a socket received on the outer surface of the drive portion, the second resilient arm having a socket engaging surface thereon and being resiliently urged against a socket received on the inner surface of the drive portion, each resilient arm for securing a socket to the drive portion of the wrench, each of said notches having a camming surface contacted by the resilient arms when the release member is moved along the first direction relative to the drive member by an operator pushing on the release member to deflect the resilient arms to move the socket contacting surfaces out of engagement with a socket on the wrench to release the socket.

17. The wrench of claim 16 wherein the drive member is mounted on the handle for rotation about a rotational axis, said wrench further including ratchet means for selectively ratcheting the handle in either rotational direction about the rotational axis relative to the drive member.

18. The wrench of claim 17 wherein said handle has a cylindrical aperture formed therethrough centered on the rotational axis, the wall defining the cylindrical aperture having ratchet teeth thereon, the drive member defining a slide surface facing the ratchet teeth on the handle, said ratchet means including:

a pawl positioned between the slide surface and the ratchet teeth on the handle and defining first and second sets of ratchet teeth in facing relation with the ratchet teeth on the handle; and means including a first structure for contacting the pawl and a second structure to be contacted by the operator of the wrench, said means for moving the pawl between first and second positions relative to the slide surface through contact between said first structure and the pawl when the operator contacts the second structure and moves the second structure so that the first structure moves the pawl to the first position so that in the first position, the first set of ratchet teeth on the pawl and ratchet teeth on the handle engage when the handle is rotated in a first direction relative to the drive member about the rotational axis for joint rotation of the handle and drive member, said means including a resilient third structure acting on the first structure to hold the pawl in the first position while permitting the first set of ratchet teeth on the drive member and ratchet teeth on the handle to slip past each other when the handle is rotated in the opposite direction about the rotational axis relative to the drive member, said means for moving permitting movement of the pawl to the second position through contact between said first structure and the pawl when the operator contacts the second structure to move the first structure so that the pawl is in the second position, the pawl in the second position engaging the second set of teeth of the pawl with the ratchet teeth on the handle so that joint rotation of the handle and drive member occurs when the handle is rotated in the opposite direction about the rotational axis relative to the drive member, said resilient third structure acting on the first structure to hold the pawl in the second position while permitting the second set of ratchet teeth on the drive member and ratchet teeth on the handle to move past each other when the handle is rotated in the first direction about the rotational axis relative to the drive member.

19. The wrench of claim 17 wherein said handle has a cylindrical aperture formed therethrough centered on the rotational axis, said drive member being mounted to the handle for rotation about the rotational axis, the wall defining the cylindrical aperture having ratchet teeth thereon, the drive member having at least one inset in facing relation to the ratchet teeth on the handle, said ratchet means including:

first and second pawls having ratchet teeth formed thereon;

pivot pins for pivotally mounting said first and second pawls in selected ones of the insets of the drive member for pivotal motion about a pivot axis parallel the rotational axis;

spring means acting between said first pawl and said drive member and said second pawl and said drive member for urging the ratchet teeth on the first and second pawls into engagement with the ratchet teeth on the handle, the ratchet teeth on the pawls and handle being shaped so that engagement of the ratchet teeth on the first pawl and ratchet teeth on the handle is maintained as the handle is rotated in a first direction about the rotational axis relative to the drive member to prevent rotation of the handle relative to the drive member in the first direction about the rotational axis while the teeth on the handle and first pawl disengage as the handle is rotated in the opposite direction about the rotational axis relative to the drive member to permit independent rotation of the handle in the opposite direction about the rotational axis, engagement of the ratchet teeth on the second pawl and the ratchet teeth of the handle is maintained as the handle is rotated in the opposite direction about the rotational axis relative to the drive member to prevent rotation of the handle relative to the drive member in the opposite direction about the rotational axis while the teeth on the handle and second pawl disengage as the handle is rotated in the first direction about the rotational axis relative to the drive member to permit independent rotation of the handle in the first direction about the rotational axis; and an annular reverser plate mounted for pivotal motion on said drive member, a hole through the annular reverser plate coinciding with the aperture through the drive member, said annular reverser plate having a first member for contacting the first pawl to cam the pawl out of engagement with the ratchet teeth on the head and a second member for contacting the second pawl to cam the second pawl out of engagement with the ratchet teeth on the handle, pivotal motion of said annular reverser plate selectively camming one of said first and second pawls to disengage the ratchet teeth thereon and the ratchet teeth on the handle to permit relative rotation between the handle and drive member in a selected direction about the rotational axis.

20. A wrench assembly for receiving a socket to rotate a fastener, each of the sockets having a portion for attachment to a wrench and a portion for engaging the fastener, the sockets each having an aperture therethrough for allowing the socket to engage the fastener when an object extends from the fastener by permitting the object to extend into the aperture, comprising:

a handle having a head at one end thereof; and a drive member for mounting on the head, said drive member having a drive portion with inner and outer surfaces extending along a first direction relative to the drive member, the outer surface of the drive portion having a hexagonal cross section perpendicular the first direction and adapted for receiving a socket, the inner surface of the drive portion having a hexagonal cross section perpendicular the first direction and adapted for receiving a socket, said drive member and drive portion having a through aperture formed therein which forms a continuation of the aperture through the socket when the socket is received on the wrench which permits the object to extend through the drive member and drive portions when rotating the fastener;

a release member mounted in the drive member for limited movement along the first direction with respect to the drive member and having a finger contacting surface; and at least one resilient arm extending from a first end of the release member and extending through a notch formed in the drive portion extending along the first direction, the resilient arm having a socket engaging surface thereon and being resiliently urged against a socket received on one of the surfaces of the drive portion, the resilient arm for securing a socket to the ratchet wrench, said notch having a camming surface contacted by the resilient arm when the release member is moved along the first direction with respect to the drive portion by an operator pushing on the finger contacting surface to deflect the resilient arm to move the socket contacting surface out of engagement with the socket on the wrench to release the socket.

21. The wrench assembly of claim 20 further comprising a socket, said socket having a wrench engaging portion thereon, the outer surface of the wrench engaging portion having a hexagonal cross section and adapted for engagement with the inner surface of the drive portion of the drive member, said socket further having a fastener engaging portion for engaging a fastener.

22. The wrench assembly of claim 20 further comprising a socket, the socket having a wrench engaging portion defining an aperture extending into the wrench engaging portion, the walls of the aperture having a hexagonal cross section and adapted for engagement with the outer surface of the drive portion of the drive member, the socket further having a fastener engaging portion for engaging a fastener.

23. The wrench assembly of claims 21 or 22 further including an extension, the extension having a wrench engaging portion having an outer surface with a hexagonal cross section adapted for engagement with the inner surface of the drive portion of the drive member in the wrench assembly, the extension further having a socket engaging portion having inner and outer surfaces, the outer surface of the socket engaging portion of the extension having a noncircular cross section adapted for receiving a socket and the inner surface of the drive portion having a noncircular cross section adapted for receiving a socket, the outer and inner surfaces of said socket engaging portion of the extension being substantially identical to the outer and inner surfaces on the drive portion of the drive member, respectively.

24. A wrench assembly for receiving a socket to rotate a fastener, comprising:

a handle having a head at one end thereof; and a drive member for mounting on the head, said drive member having a drive portion with inner and outer surfaces extending along a first direction, the outer surface of the drive portion having a hexagonal cross section perpendicular to the first direction and adapted for receiving a socket, the inner surface of the drive portion having a hexagonal cross section perpendicular to the first direction and adapted for receiving a socket, said drive member mounted for rotation relative to said handle about a rotational axis;

a member mounted on a drive member for limited movement along the rotational axis relative to the drive member and having a finger contacting surface thereon; and first and second resilient arms each extending from the member, the drive portion having first and second slots formed therein extending parallel the rotational axis, the first slot opening through the outer surface of the drive portion and the second slot opening through the inner surface of the drive portion, the first and second resilient arms extending through the first and second slots, respectively, the first resilient arm having a socket engaging surface thereon and being resiliently urged against a socket received on the outer surface of the drive portion, the second resilient arm having a socket engaging surface and being resiliently urged against a socket received on the inner surface of the drive portion, each resilient arm for securing a socket to the wrench, each of the slots having a camming surface contacted by the resilient arms when the member is moved along the rotational axis relative to the drive member by an operator pushing on the finger contacting surface to deflect the resilient arms to move the socket engaging surfaces out of engagement with the socket on the wrench to release the socket.

25. The wrench assembly of claims 20 or 24 wherein the wrench has a cylindrical aperture formed therethrough, the drive member being mounted through the cylindrical aperture for rotation about a rotational axis, said wrench further comprising ratchet means for selectively ratcheting the handle in either rotational direction about the rotational axis relative to the drive member.

26. The wrench assembly of claim 25 wherein the wall of the handle defining the cylindrical aperture has ratchet teeth thereon, the drive member defining a slide surface facing the ratchet teeth on the handle, the drive member further defining a curvilinear notch proximate the slide surface, said ratchet means including:

a pawl positioned between the slide surface on the drive member and the ratchet teeth of the handle and defining first and second sets of ratchet teeth in facing relation to the ratchet teeth on the handle;

a resilient member extending through the curvilinear notch and secured to the pawl;

means for moving the resilient member between first and second ends of the curvilinear notch, movement of the resilient member sliding the pawl in the direction of movement of the resilient member so that when the resilient member is at the first end of the curvilinear notch, the first set of ratchet teeth on the pawl engage the ratchet teeth on the handle, the first set of ratchet teeth on the pawl and ratchet teeth on the handle maintaining engagement to prevent motion of the handle relative to the drive member in a first direction about the rotational axis while disengaging to permit the ratchet teeth to slide over each other when the handle is rotated in the opposite direction, when said means for moving said resilient member moves the resilient member adjacent to the second end of the curvilinear notch, the second set of ratchet teeth on the pawl are engaged with the ratchet teeth on the handle, the second set of ratchet teeth on the pawl and ratchet teeth on the handle maintaining engagement to prevent the handle from rotating in the opposite direction relative to the drive member while disengaging to permit the teeth to slide over each other when the handle is rotated in the first direction relative to the drive member; and the resilient member urging the first set of ratchet teeth on the pawl into engagement with the ratchet teeth on the handle when the resilient member is at the first end of the curvilinear notch to create a ratcheting action and the resilient member urging the second set of ratchet teeth on the pawl into engagement with the ratchet teeth on the handle when the resilient member is at the second end of the curvilinear notch to create a ratcheting action.

27. The wrench of claim 25 wherein the wall defining the cylindrical aperture has ratchet teeth thereon, the drive member having at least one inset in facing relationship to the ratchet teeth on the handle, said ratchet means including:

first and second pawls having ratchet teeth formed thereon;

pins for pivotally mounting said first and second pawls in selected ones of the insets in the drive member for pivotal motion about a pivot axis parallel the rotational axis;

spring means acting between said first pawl and said drive member and said second pawl and said drive member for urging the ratchet teeth on the first and second pawls into engagement with the ratchet teeth on the handle, the ratchet teeth on the first pawl and handle being shaped so that engagement of the ratchet teeth on the first pawl and ratchet teeth on the handle is maintained as the handle is rotated in a first direction about the rotational axis relative to the handle to prevent rotation of the handle relative to the drive member in the first direction about the rotational axis while the teeth on the first pawl and handle disengage as the handle is rotated in the opposite direction about the rotational axis relative to the drive member to permit rotation in the opposite direction, the ratchet teeth on the second pawl and handle being shaped so that engagement of the ratchet teeth on the second pawl with the ratchet teeth on the handle is maintained as the handle is rotated in the opposite direction about thee rotational axis relative to the drive member to prevent rotation of the handle relative to the drive member in the opposite direction while the teeth on the head and second pawl disengage as the handle is rotated in the first direction about the rotational axis relative to the drive member to permit rotation in the first direction; and camming means for selectively camming one of the said first and second pawls about its pivot axis to disengage the ratchet teeth on the cammed pawl and the ratchet teeth on the handle to permit relative rotation between the handle and drive member in a selected direction, said camming means having an aperture therethrough aligned with the aperture formed in the drive member and the drive portion.

28. A ratchet wrench for rotating a fastener, comprising:

a first member forming a handle for grasping by an operator defining an annular distribution of ratchet teeth centered about a first axis;

a second member cooperating with the first member for relative rotation therebetween about the first axis, said second member having a slide surface formed thereon in facing relationship to the ratchet teeth on the first member;

a drive portion connected to said second member, the drive portion having an outer surface having a noncircular cross section for operable connection to a fastener for rotating the fastener and an inner surface having a noncircular cross section for operative connection to a fastener for rotation of the fastener, said drive portion further defining an aperture extending therethrough along said first axis, said second member also having an aperture therethrough along the first axis;

a pawl positioned between the slide surface on the second member and ratchet teeth on the first member and defining first and second sets of ratchet teeth in facing relation to the ratchet teeth on the first member; and means including a first structure for contacting the pawl and a second structure to be contacted by the operator of the ratchet wrench, said means for moving the pawl between first and second positions relative to the slide surface through contact between said first structure and the pawl when the operator contacts the second structure to reverse the ratcheting action so that in the first position, the first set of ratchet teeth on the pawl and ratchet teeth on the first member engage when the first member is rotated in a first direction about the first axis relative to the second member for joint rotation of the first and second members, said means including a resilient third structure acting on the first structure to hold the pawl in the first position while permitting the first set of ratchet teeth on a pawl and ratchet teeth on the first member to slip past each other when the first member is rotated in the opposite direction relative to the second member, said means for moving permitting movement of the pawl to the second position through contact between said first structure and said pawl when the operator contacts the second structure to reverse the ratcheting action of the ratchet wrench so that the pawl in the second position engages the second set of teeth on the pawl and the ratchet teeth on the first member so that joint rotation of the first and second members occurs when the first member is rotated in the opposite direction relative to the second member, said resilient third structure acting on the first structure to hold the pawl in the second position while permitting the second set of ratchet teeth on the pawl and ratchet teeth on the first member to move past each other when a first member is rotated in a first direction relative to the second member.

29. A ratchet wrench for rotating a fastener, comprising:

a handle having a head at one end thereof, the head having a cylindrical aperture formed therethrough centered on a rotational axis, the wall defining the cylindrical aperture having ratchet teeth thereon;

a drive member for mounting onto said handle and extending into the cylindrical aperture for rotation about the rotational axis relative to said handle, said drive member being operably connectable to the fasteners so that rotation of the drive member rotates the fastener, said drive member defining a slide surface facing the ratchet teeth on the head, said drive member further defining a first notch extending into the drive member and opening adjacent the slide surface, said drive member further having a spring recess formed therein and a second notch extending through the drive member opening adjacent the spring recess;

a pawl positioned between the slide surface and the ratchet teeth on the head and defining first and second sets of ratchet teeth in facing relation to the ratchet teeth on the head;

a resilient spring positioned between the spring recess and head; and a reverser member mounted on said drive member for pivotal motion about the rotational axis relative to the drive member, said reverser member having a pin extending through the second notch in the drive member and engaging the spring, the reverser member further having means for moving the pawl extending through the first notch adjacent the slide surface and connected to the pawl, the pin on the reverser member being movable between first and second ends of the second notch adjacent the spring recess by pivoting the reverser member about the rotational axis, the spring acting to urge the pin against the first and second ends of the second notch when the pin is proximate the first and second ends of the second notch, respectively, pivoting the reverser member about the rotational axis until the pin contacts the first end of the second notch moving said means for moving the pawl so that the means for moving the pawl moves the pawl with respect to the drive member to a first position so that the first set of ratchet teeth on the pawl and ratchet teeth on the head engage when the handle is rotated in a first direction about the rotational axis relative to the drive member for joint rotation of the handle and drive member while permitting the first set of ratchet teeth on the pawl and ratchet teeth on the head to slip past each other when the handle is rotated in the opposite direction relative to the drive member with the spring acting on the reverser member and means for moving the pawl to urge the ratchet teeth into engagement to cause a ratcheting action, pivoting the reverser member about the rotational axis until the pin contacts the second end of the second notch causing the means for moving the pawl to move the pawl to a second position engaging the second set of teeth on the pawl and the ratchet teeth on the head so that joint rotation of the handle and drive member occurs when the handle is rotated in the opposite direction relative to the drive member while permitting the second set of ratchet teeth on the pawl and ratchet teeth on the head to move past each other when the handle is rotated in the first direction relative to the drive member, the spring exerting a force on the reverser member and means for moving the pawl when the pawl is in the second position to urge the ratchet teeth into engagement to cause a ratcheting action.

30. The ratchet wrench of claim 29 wherein said means for moving the pawl comprises a resilient spring connected to the pawl.

31. The ratchet wrench of claim 29 wherein said pawl has a notch formed therein between the first and second sets of ratchet teeth, said means for moving the pawl comprising a rigid pin, said rigid pin extending into the notch formed in the pawl.

32. A wrench for use with sockets for rotating a fastener, each of the sockets having a portion for attachment to a wrench and a portion for engaging the fastener, the sockets each having an aperture therethrough for allowing the socket to engage the fastener when an object extends from the fastener by permitting the object to extend into the aperture, said wrench comprising:

a handle;

a drive portion mounted on the handle and having a drive portion, the drive portion having inner and outer surfaces, the outer surface of the drive portion having a noncircular cross section adapted for receiving a socket and the inner surface of the drive portion having a noncircular cross section adapted for receiving a socket, said drive member and drive portion having a through aperture formed therein which forms a continuation of the aperture through a socket when the socket is received on the wrench permitting the object to extend through the drive member and drive portion, the drive member being mounted on the handle for rotation about a rotational axis;

ratchet means for selectively ratcheting the handle in either rotational direction about the rotational axis relative to the drive member;

said handle having a cylindrical aperture formed therethrough centered on the rotational axis, the wall defining the cylindrical aperture having ratchet teeth thereon, the drive member defining a slide surface facing the ratchet teeth on the handle, said ratchet means including:

a pawl positioned between the slide surface and the ratchet teeth on the handle and defining first and second sets of ratchet teeth in facing relation with the ratchet teeth on the handle; and means including a first structure for contacting the pawl and a second structure to be contacted by the operator of the wrench, said means for moving the pawl between first and second positions relative to the slide surface through contact between said first structure and the pawl when the operator contacts the second structure and moves the second structure so that the first structure moves the pawl to the first position so that in the first position, the first set of ratchet teeth on the pawl and ratchet teeth on the handle engage when the handle is rotated in a first direction relative to the drive member about the rotational axis for joint rotation of the handle and drive member, said means including a resilient third structure acting on the first structure to hold the pawl in the first position while permitting the first set of ratchet teeth on the drive member and ratchet teeth on the handle to slip past each other when the handle is rotated in the opposite direction about the rotational axis relative to the drive member, said means for moving permitting movement of a pawl to the second position through contact between said first structure and the pawl when the operator contacts the second structure to move the first structure so that the pawl is in the second position, the pawl in the second position engaging the second set of teeth of the pawl with the ratchet teeth on the handle so that joint rotation of the handle and drive member occurs when the handle is rotated in the opposite direction about the rotational axis relative to the drive member, said resilient third structure acting on the first structure to hold the pawl in the second position while permitting the second set of ratchet teeth on the drive member and ratchet teeth on the handle to move past each other when the handle is rotated in the first direction about the rotational axis relative to the drive member.

33. A wrench for use with sockets for rotating a fastener, each of the sockets having a portion for attachment to a wrench and a portion for engaging the fastener, the sockets each having an aperture therethrough for allowing the socket to engage the fastener when an object extends from the fastener by permitting the object to extend into the aperture, said wrench comprising a handle;

a drive member mounted on the handle and having a drive portion, the drive portion having inner and outer surfaces, the outer surface of the drive portion having a noncircular cross section adapted for receiving a socket and the inner surface of the drive portion having a noncircular cross section adapted for receiving a socket, said drive member and drive portion having a through aperture formed therein which forms a continuation of the aperture through a socket when the socket is received on the wrench permitting the object to extend through the drive member and drive portion, the drive member being mounted on the handle for rotation about a rotational axis; and ratchet means for selectively ratcheting the handle in either rotational direction about the rotational axis relative to the drive member, the handle having a cylindrical aperture formed therethrough centered on the rotational axis, said drive member being mounted to the handle for rotation about the rotational axis, a wall defining the cylindrical aperture having ratchet teeth thereon, the drive member having at least one inset in facing relation to the ratchet teeth on the handle, said ratchet means including:

first and second pawls having ratchet teeth formed thereon;

pivot pins for pivotally mounting said first and second pawls in selected ones of the insets of the drive member for pivotal motion about a pivot axis parallel to the rotational axis;

spring means acting between said first pawl and said drive member and said second pawl and said drive member for urging the ratchet teeth on the first and second pawls to engagement with the ratchet teeth on the handle, the ratchet teeth on the pawls and handle being shaped so that engagement of the ratchet teeth on the first pawl and ratchet teeth on the handle is maintained as the handle is rotated in a first direction about the rotational axis relative to the drive member to prevent rotation of the handle relative to the drive member in the first direction about the rotational axis while the teeth on the handle and first pawl disengage as the handle is rotated in the opposite direction about the rotational axis relative to the drive member to permit independent rotation of the handle in the opposite direction about the rotational axis, engagement of the ratchet teeth on the second pawl and the ratchet teeth of the handle is maintained as the handle is rotated in the opposite direction about the rotational axis relative to the drive member to prevent rotation of the handle relative to the drive member in the opposite direction about the rotational axis while the teeth on the handle and second pawl disengage as the handle is rotated in the first direction about the rotational axis relative to the drive member to permit independent rotation of the handle in the first direction about the rotational axis; and an annular reverser plate mounted for pivotal motion on said drive member, a hole through the annular reverser plate coinciding with the aperture through the drive member, said annular reverser plate having a first member for contacting the first pawl to cam the pawl out of engagement with the ratchet teeth on the head and a second member for contacting the second pawl to cam the second pawl out of engagement with the ratchet teeth on the handle, pivotal motion of said annular reverser plate selectively camming one of said first and second pawls to disengage the ratchet teeth thereon and the ratchet teeth on the handle to permit relative rotation between the handle and drive member in a cylindrical direction about the rotational axis.

34. A wrench assembly for receiving a socket to rotate a fastener, each of the sockets having a portion for attachment to a wrench and a portion for engaging the fastener, the sockets each having an aperture therethrough for allowing the socket to engage the fastener when an object extends from the fastener by permitting the object to extend into the aperture, comprising:

a handle having a head at one end thereof;

a drive member for mounting on the head, said drive member having a drive portion with inner and outer surfaces extending along a first direction relative to the drive member, the outer surface of the drive portion having a hexagonal cross section perpendicular to the first direction and adapted for receiving a socket, the inner surface of the drive portion having a hexagonal cross section perpendicular to the first direction and adapted for receiving a socket, said drive member and drive portion having a through aperture formed therein which forms a continuation of the aperture through the socket when the socket is received on the wrench which permits the object to extend through the drive member and drive portion when rotating a fastener;

the wrench having a cylindrical aperture formed therethrough, the drive member being mounted through the cylindrical aperture for rotation about a rotational axis;

ratchet means for selectively and ratcheting the handle in either rotational direction about the rotational axis relative to the drive member, a wall of the handle defining the cylindrical aperture having ratchet teeth thereon, the drive member defining a slide surface facing the ratchet teeth on the handle, the drive member further defining a curvilinear notch proximate the slide surface, said ratchet means including:

a pawl positioned between the slide surface on the drive member and the ratchet teth of the handle and defining first and second sets of ratchet teeth in facing relation to the ratchet teeth on the handle;

a resilient member extending through the curvilinear notch secured to the pawl;

means for moving the resilient member between first and second ends of the curvilinear notch, movement of the resilient member sliding the pawl in the direction of movement of the resilient member so that when the resilient member is at the first end of the curvilinear notch, the first set of ratchet teeth on the pawl engage the ratchet teeth on the handle, the first set of ratchet teeth on the pawl and ratchet teeth on the handle maintaining engagement to prevent motion of the handle relative to the drive member in a first direction about the rotational axis while disengaging to permit the ratchet teeth to slide over each other when the handle is rotated in the opposite direction, when said means for moving said resilient member moves the resilient member adjacent to the second end of the curvilinear notch, the second set of ratchet teeth on the pawl are engaged with the ratchet teeth on the handle, the second set of ratchet teeth on the pawl and ratchet teeth on the handle maintaining engagement to prevent the handle from rotating in the opposite direction relative to the drive member while disengaging to permit the teeth to slide over each other when the handle is rotated in the first direction relative to the drive member; and the resilient member urging the first set of ratchet teeth on the pawl into engagement with the ratchet teeth on the handle when the resilient member is at the first end of the curvilinear notch to create a ratcheting action and the resilient member urging the second set of ratchet teeth on the pawl into engagement with the ratchet teeth on the handle when the resilient member is at the second end of the curvilinear notch to create a ratcheting action.

35. A wrench assembly for receiving a socket to rotate a fastener, each of the sockets having a portion for attachment to a wrench and a portion for engaging the fastener, the sockets each having an aperture therethrough for allowing the sockets to engage the fastener when an object extends from the fastener by permitting the object to extend into the aperture, comprising:

a handle having a head at one end thereof;

a drive member for mounting on the head, said drive member having a drive portion with inner and outer surfaces extending along a first direction relative to the drive member, the outer surface of the drive portion having a hexagonal cross section perpendicular to the first direction and adapted for receiving a socket, the inner surface of the drive portion having a hexagonal cross section perpendicular to the first direction and adapted for receiving a socket, the drive member and drive portion having a through aperture formed therein which forms a continuation of the aperture through the socket when the socket is received on the wrench which permits the object to extend through the drive member and drive portions rotating a fastener;

the wrench having a cylindrical aperture formed therethrough, the drive member being mounted through the cylindrical aperture for rotation about a rotational axis, the wrench further comprising ratchet means for selectively ratcheting the handle in either rotational direction about the rotational axis relative to the drive member, a wall defining the cylindrical aperture having ratchet teeth thereon, the drive member having at least one inset in facing relationship to the ratchet teeth on the handle, said ratchet means including:

first and second pawls having ratchet teeth formed thereon;

pins for pivotally mounting said first and second pawls and selected ones in the insets in the drive member for pivotal motion about a pivot axis parallel to the rotational axis;

spring means acting between said first pawl and said drive member and said second pawl and said drive member for urging the ratchet teeth on the first and second pawls into engagement with the ratchet teeth on the handle, the ratchet teeth on the first pawl and handle being shaped so that engagement of the ratchet teeth on the first pawl and ratchet teeth on the handle is maintained as the handle is rotated in a first direction about the rotational axis relative to the handle to prevent rotation of the handle relative to the drive member in the first direction about the rotational axis while the teeth on the first pawl and handle disengage as the handle is rotated in the opposite direction about the rotational axis relative to the drive member to permit rotation in the opposite direction, the ratchet teeth on the second pawl and handle being shaped so that engagement of the ratchet teeth on the second pawl with the ratchet teeth on the handle is maintained as the handle is rotated in the opposite direction about the rotational axis relative to the drive member to prevent rotation on the handle relative to the drive member in the opposite direction while the teeth on the head and second pawl disengage as the handle is rotated in the first direction about the rotational axis relative to the drive member to permit rotation in the first direction;

camming means for selectively camming one of said first and second pawls about a pivot axis to disengage the ratchet teeth on the cammed pawl and the ratchet teeth on the handle to permit relative rotation between the handle and drive member in a selective direction said camming means having an aperture therethrough aligned with the aperture formed in the drive member and the drive portion.

* * * * *

UNITED STATES PATENT AND TRADEMARK OFFICE

CERTIFICATE OF CORRECTION

PATENT NO. : 4,520,697

DATED : June 4, 1985

INVENTOR(S) : John B. Moetteli

It is certified that error appears in the above-identified patent and that said Letters Patent is hereby corrected as shown below:

Column 9, line 1, change "the" to --an--.

Column 11, line 26, change "rotational" to --rotation--.

Column 11, line 58, after "defining" delete "a".

Column 13, line 2, after "defining" delete "a".

Column 23, line 18, change "thee" to --the--.

Column 28, line 36, change "teth" to --teeth--.

Signed and Sealed this

*Fifteenth* Day of *October 1985*

[SEAL]

*Attest:*

DONALD J. QUIGG

*Attesting Officer*

*Commissioner of Patents and Trademarks—Designate*